US006656063B2

(12) United States Patent
Prichard

(10) Patent No.: US 6,656,063 B2
(45) Date of Patent: Dec. 2, 2003

(54) PRACTICE BALL HITTING DEVICE

(76) Inventor: Robert Prichard, 203 Golden Hind Passage, Corte Madera, CA (US) 94925

( * ) Notice: Subject to any disclaimer, the term of this patent is extended or adjusted under 35 U.S.C. 154(b) by 0 days.

(21) Appl. No.: 09/993,016

(22) Filed: Nov. 14, 2001

(65) Prior Publication Data

US 2003/0092512 A1 May 15, 2003

(51) Int. Cl.[7] ..... A63B 69/00; A63B 69/36; A63B 57/00

(52) U.S. Cl. ..... 473/429; 473/423; 473/145; 473/139

(58) Field of Search ..... 473/422, 423, 473/424, 427, 428, 429, 431, 145, 148, 188; 273/417–418

(56) References Cited

U.S. PATENT DOCUMENTS 2,245,739 A * 6/1941 Thomas ..... 473/145
3,118,670 A * 1/1964 Smith ..... 473/429
3,472,075 A * 10/1969 Oppenheimer ..... 473/145
4,204,678 A * 5/1980 Weis ..... 473/423
5,386,988 A * 2/1995 Sung et al. ..... 473/423
5,393,050 A * 2/1995 Lloyd ..... 473/429
5,467,979 A * 11/1995 Zarate ..... 473/429
5,613,922 A * 3/1997 Hsiang ..... 473/435
5,690,565 A * 11/1997 Swanson ..... 473/417
5,795,251 A * 8/1998 Andersen ..... 473/427
5,833,555 A * 11/1998 Jer-Min ..... 473/429
6,129,637 A * 10/2000 Wang et al. ..... 473/145
6,146,283 A * 11/2000 Ferguson, III ..... 473/145
6,475,108 B1 * 11/2002 Sarenana et al. ..... 473/420

* cited by examiner

*Primary Examiner*—Paul T. Sewell
*Assistant Examiner*—Mitra Aryanpour
(74) *Attorney, Agent, or Firm*—Michael A. Shippey

(57) ABSTRACT

Practice ball hitting device with a hollow housing made of molded rigid plastic material having a parallel pair of spaced apart triangular side planes joined at their perimeter by a flat plane that forms a bottom and inwardly angled sides, the flat sides having a removed U shaped section at the apex portion of the triangular planes, an S shaped low mass arm having an integral, horizontally disposed shaft, the shaft being slip fit into sockets on the inside face of said U shaped cut out section, said S shaped arm terminating at each end in a ball shape, and said lower section of said housing capable of retaining water which acts as a stabilizing element. An optical encoder on the end of the shaft interacts with a photo diode to measure number of rotations of the shaft. A microprocessor translates the number of rotations into distance the ball is hit. A numeric display or an audible sound tells the distance the ball has been hit.

3 Claims, 3 Drawing Sheets

PRACTICE BALL HITTING DEVICE

BACKGROUND OF THE INVENTION

This invention relates generally to the field of ball sports practice equipment, and more particularly to a practice ball hitting device.

Games like baseball and tennis require that a player practice hitting the ball with a bat or racquet. In some instances, it is not practical for a ball player to actually hit a ball a distance during practice. For example, if a ball player lives in a location that does not have the proper space for hitting a ball a distance, or if the player does not have a partner to help retrieve the ball after it is hit.

There is then, a need for a practice ball hitting device that lets a player hit a ball that does not travel a great distance. A number of ball hitting devices have been designed for this purpose. The primary design includes a ball on a tether connected to a support stand so that a person can hit the ball with a bat and the ball will travel in a circular fashion and finally come to rest so that it can be hit again.

However there is a deficiency in this design in that a person can not easily tell how effectively he or she has hit the ball. Additionally, the apparatus for supporting the tethered ball is bulky and requires substantial stabilizing elements to keep the supporting apparatus from moving during the process of hitting the ball.

SUMMARY OF THE INVENTION

The primary object of the invention is to provide a device that helps people practice hitting a ball with a bat, racquet or the like.

Another object of the invention is to provide a practice ball hitting device that uses water to act as a stabilizing element.

Another object of the invention is to provide a practice ball hitting device that employees a low mass, revolving ball and shaft assembly.

Another object of the invention is to provide a practice ball hitting device that gives a numerical indication as to how far the ball was hit.

A further object of the invention is to provide a practice ball hitting device that gives an auditory indication as to how far the ball was hit.

Yet another object of the invention is to provide a practice ball hitting device that can be set to various skill levels.

Still yet another object of the invention is to provide a practice ball hitting device where the balls to be hit automatically are positioned in the proper location for easy hitting.

Another object of the invention is to provide a practice ball hitting device that is light weight and portable when not in use.

Another object of the invention is to provide a practice ball hitting device that is inexpensive to manufacture.

Other objects and advantages of the present invention will become apparent from the following descriptions, taken in connection with the accompanying drawings, wherein, by way of illustration and example, an embodiment of the present invention is disclosed.

Practice Ball Hitting Device comprising: a hollow housing made of molded rigid plastic material having a parallel pair of spaced apart triangular side planes joined at their perimeter by a flat plane that forms a bottom and inwardly angled sides, said flat sides having a removed U shaped section at the apex portion of said triangular planes, an S shaped hollow arm having an integral, horizontally disposed shaft, said shaft being slip fit into sockets on the inside face of said U shaped cut out section, said S shaped arm terminating at each end in a ball shape, and said lower section of said housing capable of retaining water which acts as a stabilizing element.

The drawings constitute a part of this specification and include exemplary embodiments to the invention, which may be embodied in various forms. It is to be understood that in some instances various aspects of the invention may be shown exaggerated or enlarged to facilitate an understanding of the invention.

DETAILED DESCRIPTION OF THE PREFERRED EMBODIMENTS

Detailed descriptions of the preferred embodiment are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

Figure 1:
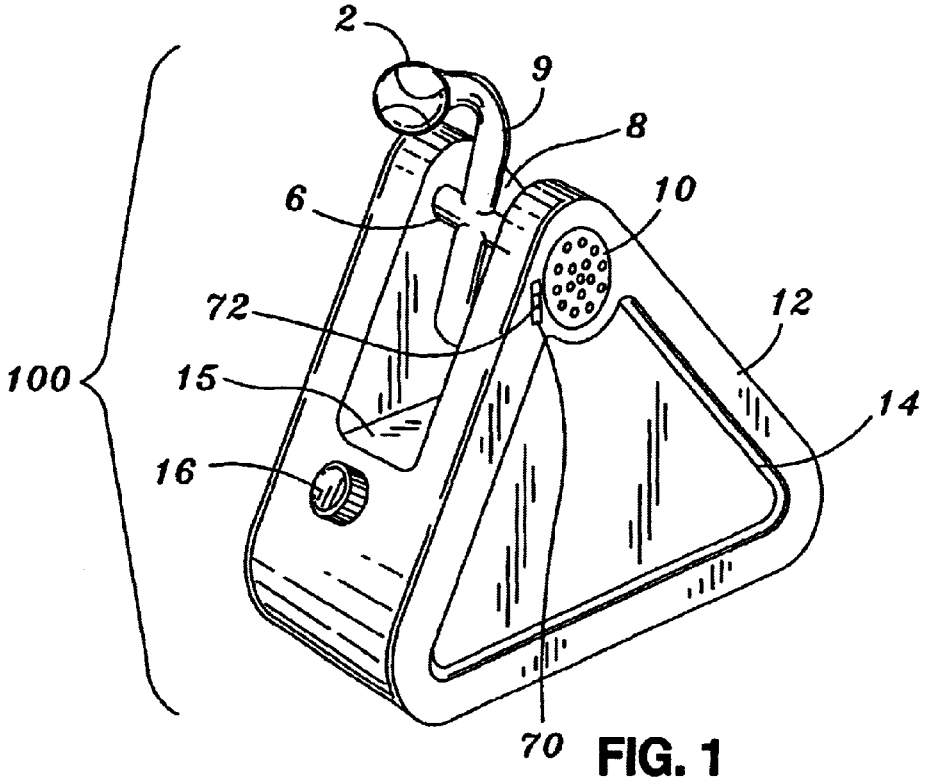
FIG. 1 is a perspective view of the ball hitting practice device of the present invention
Figure 3:
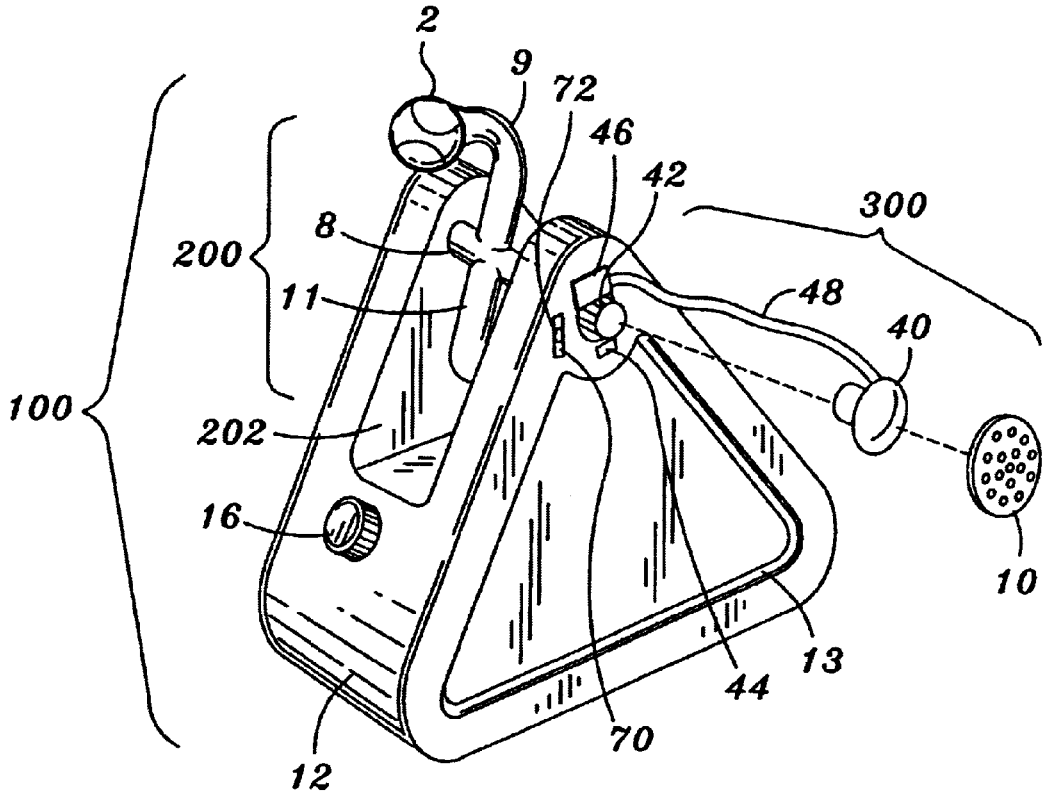
FIG. 3 is an exploded perspective view of the present invention
Figure 4:
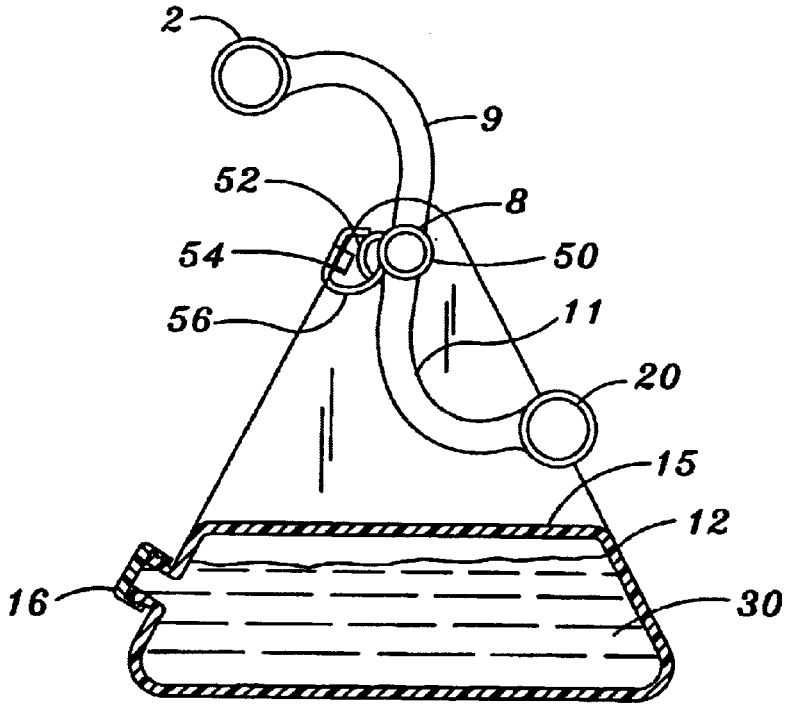
FIG. 4 is a side section view of the present invention

Referring now to FIG. 1 we see a perspective view of the ball hitting practice device of the present invention 100. The device 100 is comprised of a hollow triangular shaped housing 12, a rotatable S shaped member 200 shown in FIG. 3 and an electronic assembly 300 shown in FIG. 3. The triangular housing 12 has a removable and replaceable cap 16 that allows the user to pour water, sand or the like into the housing 12 to act as a stabilizing element. Reinforcing rib 14 helps give housing 12 rigidity on the side panels. A U shaped cutout 202 FIG. 3 is located at the apex of the triangular housing. a shaft retaining aperture located near the apex of the housing 12 retains the shaft member 8 of the S shaped assembly 200. The S shaped assembly 200 terminates at each end in a ball shaped member 2, 20. In the preferred embodiment the S shaped arm assembly is made of light weight blow molded plastic. The low mass of the S shaped arm 200 is desirable because the lighter the arm assembly, the less need there is for a heavy base assembly which is needed to keep the entire unit from moving during use. When the present invention is in use, a person hits one of the balls in assembly 200 with a bat, racquet or other hitting device. The height of balls 2, 20 when they are at their top position is approximately twenty nine inches from the ground. This height is ideal for young people between three and twelve years of age. Other models can be designed for older people. Alternately, a unit can be designed that has a plurality of vertically spaced shaft apertures so that the user could select the desired height of shaft aperture for his or her size. The electronics assembly 300 located on one side of triangular housing 12 monitors how many revolutions per minute the S shaped assembly 200 has turned thereby telling the user how well he or she has hit the ball. The electronic assembly 300 as shown in FIG. 3 is comprised of an optical encoder strip 42 that is wrapped around shaft 8, a photo diode pickup and associated microprocessor circuit 46 that can measure and translate the revolutions of shaft 8 into an audible sound through speaker 40 connected to circuit 46 by wires 48. The sound can be in terms of people cheering or the like, or it can be the sound of a person speaking a number or both. Batteries 13 power the electronic circuit. slide switch 70 can be adjusted to various settings 72 that indicate level of difficulty, so that if an inexperienced person tries the unit 100 it can be set on a low setting so that the speaker 40 will emit loud cheering even if there are not many revolutions registered. A person who has a higher level of expertise can set the slide switch 70 to a higher setting so that he or she will have to hit the ball 2 harder to create the same level of cheering or the like. Speaker enclosure 10 encloses the speaker 40 as well as the rest of the electronic assembly 300. FIG. 4 shows spring biased 54 crescent shaped member 52 retained in collar 56 engages with shaft elliptical section 50 on shaft 8 so that balls 2 or 20 end up in the top most position thereby making it ready for hitting by the user. Water 30 can be clearly seen as retained in the base of housing 12. The top of the water enclosure portion 15 is low enough so that balls 2, 20 can not hit the surface 15 when the balls are revolving about shaft 8. FIG. 4 also shows a clear view of S shaped arm 9, 11. Balls 2, 20 are molded integral to arm ends of members 9, 11.

Figure 2:
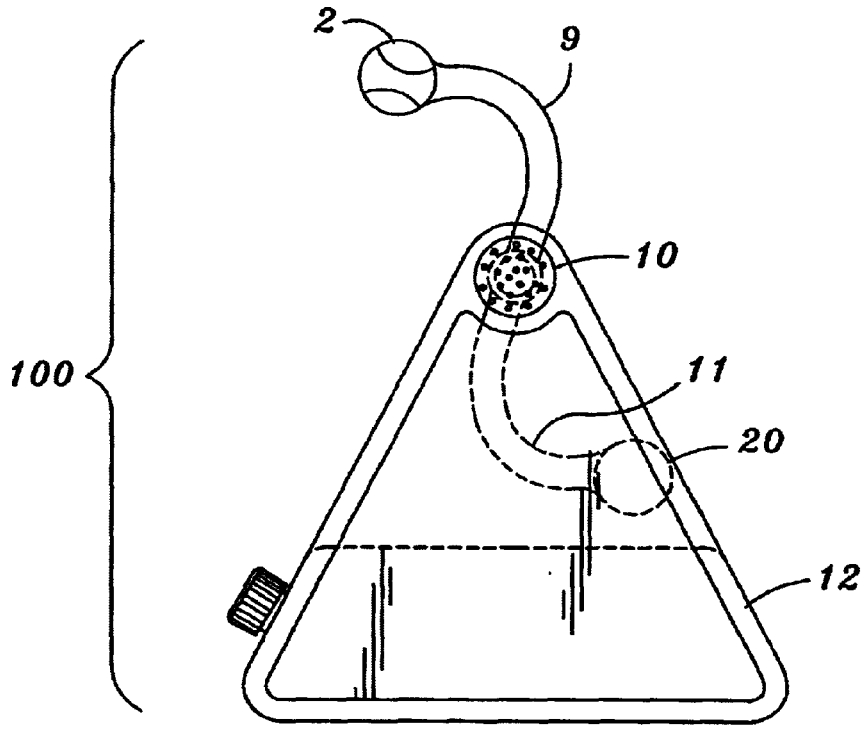
FIG. 2 is a side view of the practice ball hitting device of the present invention
Figure 5:
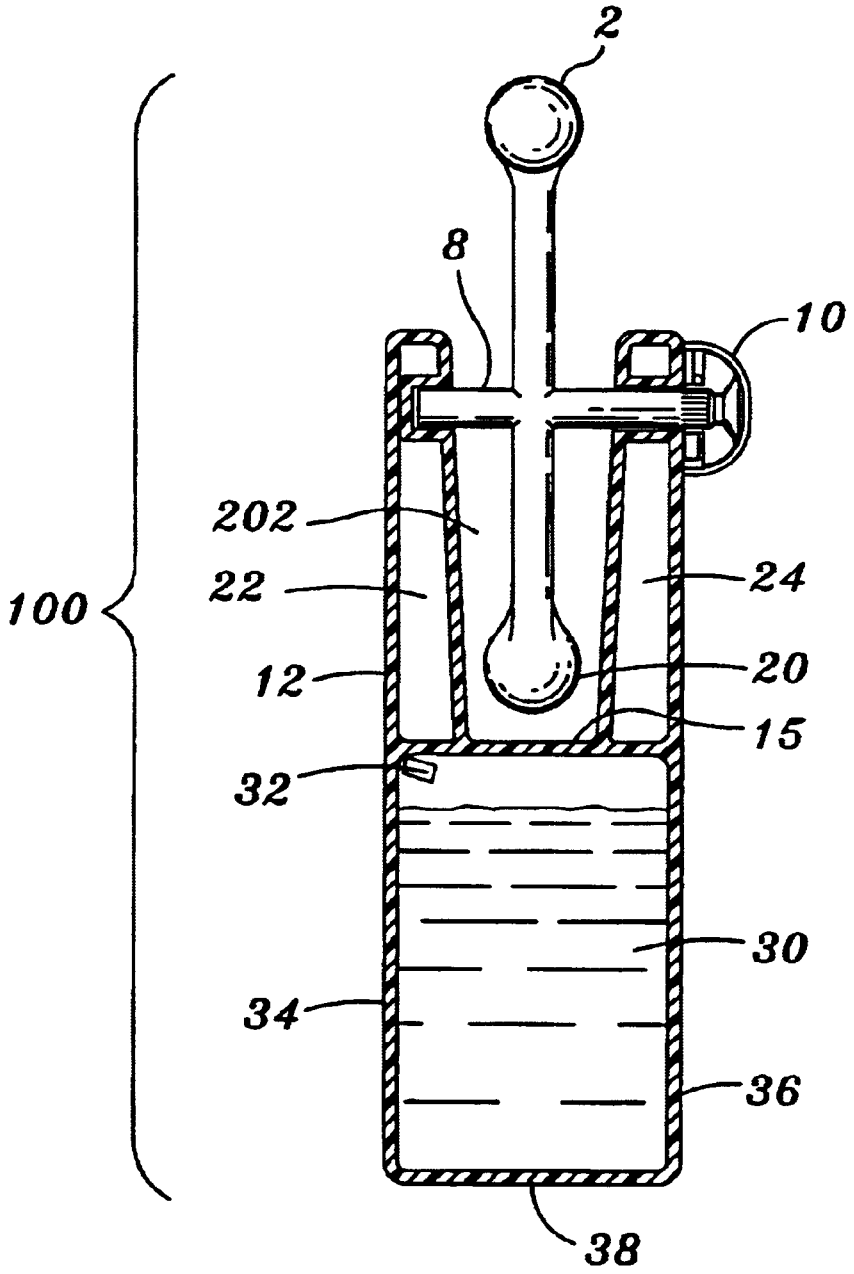
FIG. 5 is a front section view of the present invention

Housing 12 and S shaped member 200 are made of rigid blow molded or, alternately, injection molded plastic such as polypropelyne or the like. FIG. 2 helps clarify the understanding of the design by showing a side view of the present invention 100. FIG. 5 helps further clarify the design by showing a front section view of the present invention 100. This view clearly shows how shaft 8 is retained at either side of U shaped cutout portion 202 formed by members 22, 24 and 15. the lower portion of housing 12 is comprised of walls 34, 36 and base 38 and act to retain water 30.

An alternate embodiment of the present invention 100 wherein a numeric display is used in place of or in addition to the above described audio response.

In the above described and illustrated way, the present invention provides an inexpensive device that helps people practice hitting a ball with a bat or the like. The feedback gained by electronic measurement of revolutions of the shaft help tell the user how well he or she has hit the ball.

While the invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined by the appended claims.

What is claimed is:

1. A Practice Ball Hitting Device comprising:

a hollow housing made of molded rigid plastic material having a parallel pair of spaced apart triangular side planes joined at their perimeter by a flat plane that forms a bottom, and inwardly angled sides; said flat sides having a removed U shaped section at the apex portion of said triangular planes;

a hollow S shaped low mass arm having an integral, horizontally disposed shaft; said shaft being slip-fit into sockets on the inside face of said U shaped cut out section;

said S shaped arm terminating at each end in a ball shape; and said lower section of said housing capable of retaining water which acts as a stabilizing element.

2. A practice ball hitting device as claimed in claim 1 wherein said shaft of said S shaped member has an elliptical portion that engages with a spring biased crescent shaped member so that one of said balls end up in the upper most position when the revolving of the balls stops after hitting.

3. A practice ball hitting device as claimed in claim 1 wherein said housing and said S shaped member are constructed of blow molded plastic.

* * * * *